United States Patent [19]

Carr

[11] Patent Number: 4,556,211

[45] Date of Patent: Dec. 3, 1985

[54] SHEET STACKING APPARATUS AND REGISTRATION MECHANISM THEREFOR

[75] Inventor: Roger D. Carr, Endicott, N.Y.

[73] Assignee: Savin Corporation, Stamford, Conn.

[21] Appl. No.: 494,951

[22] Filed: May 16, 1983

[51] Int. Cl.[4] ..... B65H 33/02

[52] U.S. Cl. ..... 271/221; 271/236; 414/28; 414/36

[58] Field of Search ..... 271/221, 222, 223, 224, 271/220, 233, 234, 248, 236; 414/36, 28

[56] References Cited

U.S. PATENT DOCUMENTS

| | | | |
|---|---|---|---|
| 2,547,964 | 4/1951 | Nordquist et al. | 271/233 |
| 4,341,299 | 7/1982 | Walker et al. | 271/233 X |
| 4,477,218 | 10/1984 | Bean | 271/221 |

FOREIGN PATENT DOCUMENTS

| | | | |
|---|---|---|---|
| 0002575 | 1/1980 | Japan | 271/223 |

*Primary Examiner*—Bruce H. Stoner, Jr.
*Assistant Examiner*—Lawrence J. Goffney, Jr.
*Attorney, Agent, or Firm*—Shenier & O'Connor

[57] ABSTRACT

Sheet stacking and registration apparatus in which a jogging finger is slidable along an arm which is mounted for movement about a pivot axis between a lowered position and a raised position relatively adjacent the sheets being registered. The jogging finger is resiliently urged away from the stack in the raised position of the arm, while the arm is normally resiliently urged toward its lowered position. Tensioning of a line coupled to the jogging finger first draws the arm to its raised position adjacent the stack and then draws the jogging finger against the adjacent edge of the stack to register the sheets against a remote registration surface. In a preferred embodiment, a common actuating member is used to tension a plurality of such lines to actuate several jogging mechanisms simultaneously.

14 Claims, 8 Drawing Figures

Fig 1
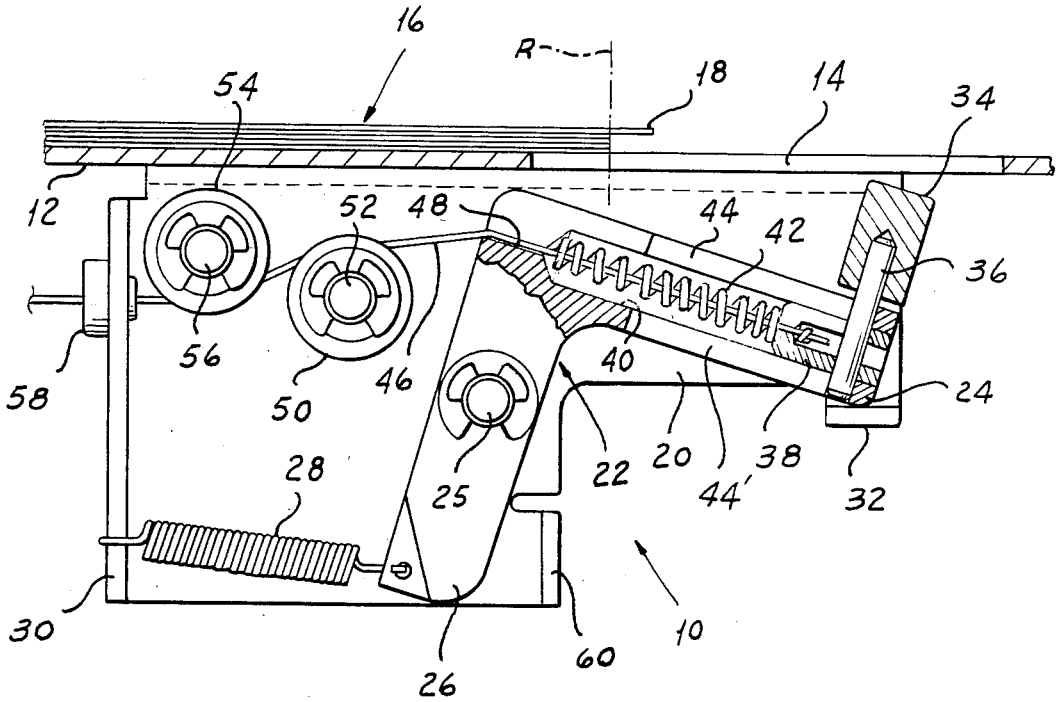
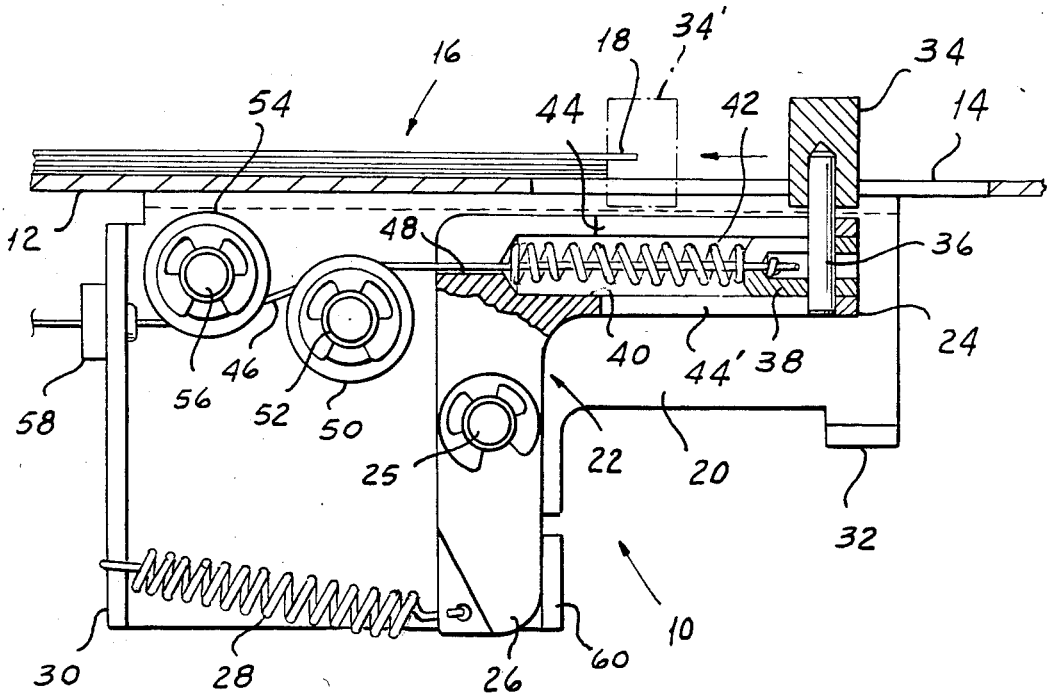
Fig 2

FIG 5
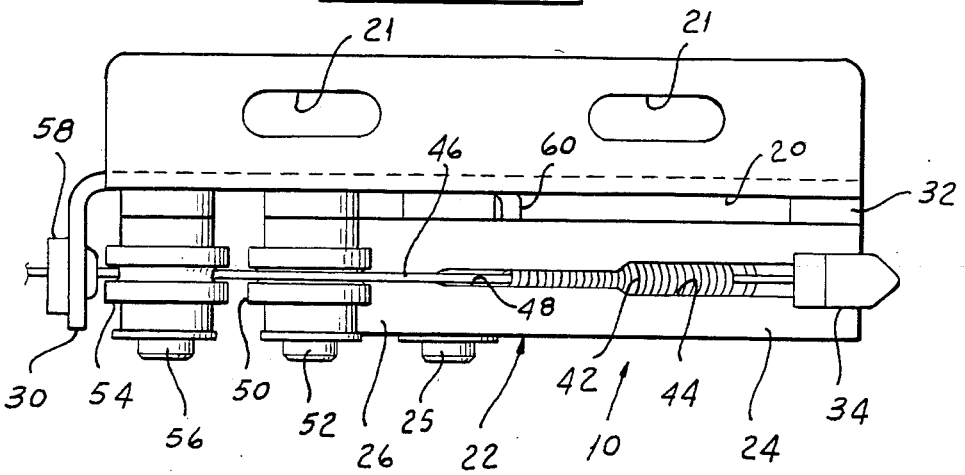
FIG 6
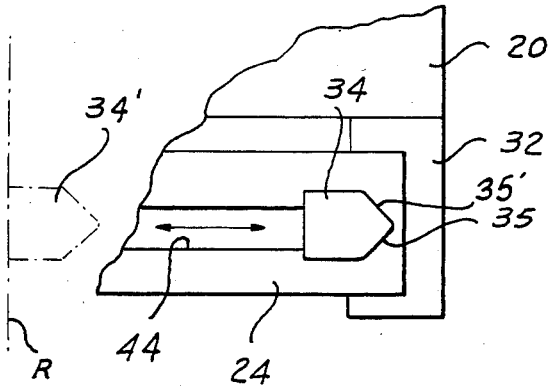
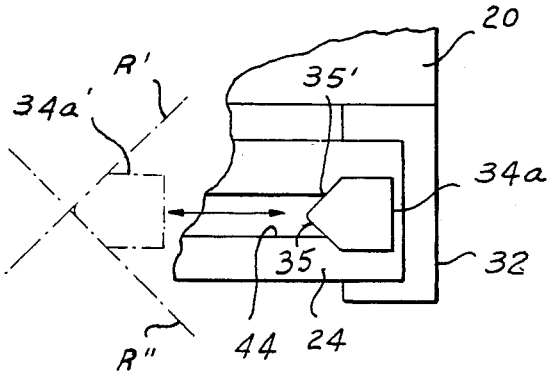
FIG 7
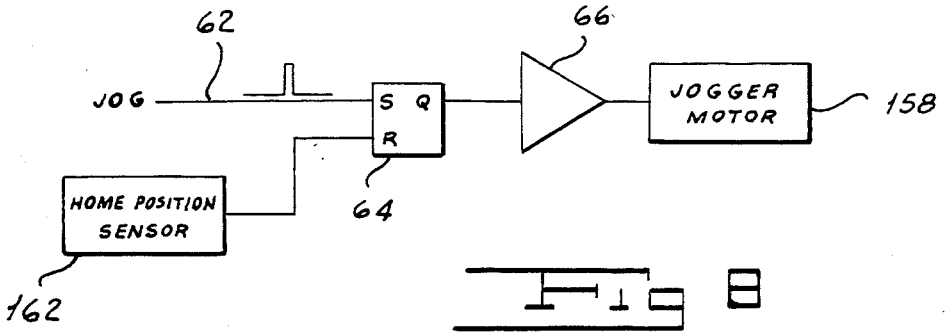
FIG 8

SHEET STACKING APPARATUS AND REGISTRATION MECHANISM THEREFOR

FIELD OF THE INVENTION

This invention relates to apparatus for stacking and registering sheets and, more particularly, to apparatus for stacking and registering copy sheets of an electrophotographic copier preparatory to stapling them into sets.

BACKGROUND OF THE INVENTION

Apparatus for stacking and registering sheets prior to an operation performed on a collected set of sheets, such as stapling, is well known in the art. Generally, in such apparatus, collected sheets are registered by moving one or more jogging elements against an edge of the stack to align the opposite edge of the stack with a registration surface, defined either by a fixed guide or by a movable registration gate. Since sheets are continually being fed to the stack, and since it is desirable to jog the stack as it is being formed, the jogging elements must be moved in such a manner as not to interfere with the sheet-feeding operation, particularly if the jogging elements act against the trailing edge of a stack. This is generally accomplished by mounting the jogging element for movement from a rest, or home, position beneath the stack-receiving surface along a path which extends upwardly through a slot or the like formed in the receiving surface and then generally horizontally against the desired edge of the stack. One such jogging mechanism is shown, for example, in U.S. Pat. No. 4,073,391, issued to O'Brien et al.

While the jogging mechanism shown in the patent to O'Brien et al is capable of jogging sheets against a leading-edge registration gate without interfering with the feeding of additional sheets to the stack, it nevertheless retains several undesirable features of operation. In particular, the assembly for actuating the trailing-edge jogging element of O'Brien et al is relatively complicated in its construction and does not readily permit variation in the placement of the jogging mechanism (other than to accommodate sheets of varying lengths) or the conjoint use of several such jogging mechanisms without unduly complex coupling arrangements.

SUMMARY OF THE INVENTION

In general, my invention contemplates sheet stacking and registration apparatus in which a jogging finger, or element, is mounted for movement relative to an arm, or support, which is itself mounted for movement, preferably about a pivot axis adjacent to the sheets being registered. To jog the sheets, the arm is first moved from an inoperative position relatively remote from the stack to an operative position, relatively adjacent to the stack, in which the jogging element is movable against an edge of the stack. Upon the movement of the arm to its operative position, the jogging element is then moved relative to the arm into engagement with the stack to register the sheets.

Preferably, the arm is biased away from a limit position relatively adjacent to the stack to a rest position relatively remote from the stack and the jogging element is biased away from the stack in that limit position of the arm. A line coupled to the jogging element is tensioned first to overcome the first biasing means to move the arm to its limit position and then to overcome the second biasing means to move the element against the stack.

By providing the jogging mechanism with a compound articulation in this manner, that is, by mounting the arm for pivotal movement and the jogging element for movement along the arm, I am able to locate the arm and jogging element normally in a rest position out of the feed path, such as below the sheet receiving surface, while at the same time providing the jogging element with a purely linear motion in the operative position of the arm so as to ensure that it strikes the stack edge directly and not obliquely as in other mechanisms of the prior art. Since, in the preferred form of my invention, both the movement of the arm to its upper position and the movement of the jogging element along the arm against the edge of the stack may be accomplished by a continuous pulling motion on an actuating line, my mechanism permits the use of an extremely simple actuating mechanism, such as a solenoid or an eccentric, which may be located a considerable distance away from the actual jogging mechanism. In addition, by coupling several such actuating lines to the same motion source, I am readily able to actuate several jogging mechanisms associated with the same sheet receiving surface with only a single drive source.

OBJECTS OF THE INVENTION

One object of my invention is to provide a sheet stacking and registration apparatus which is relatively simple in construction.

Another object of my invention is to provide a sheet stacking and registration apparatus which does not interfere with the feeding of sheets to a receiving surface.

Still another object of my invention is to provide a sheet stacking and registration apparatus, the various jogging elements of which may be commonly actuated by a single mechanism.

A further object of my invention is to provide a sheet stacking and registration apparatus which is relatively insensitive to changes in location of a jogging mechanism relative to a sheet receiving surface or actuating device.

A still further object of my invention is to provide a sheet stacking and registration apparatus in which jogging elements strike adjacent sheet edges normally from a starting position below the sheet receiving surface.

Other and further objects will be apparent from the following description.

BRIEF DESCRIPTION OF THE DRAWINGS

In the accompanying drawings which form part of the instant specification and which are to be read in conjunction therewith and in which like reference characters are used to indicate like parts in the various views:

FIG. 1 is a fragmentary front elevation, with parts in section, of a preferred embodiment of my sheet jogger with the jogger arm in its rest position.

FIG. 2 is a fragmentary front elevation, with parts in section, of the sheet jogger of FIG. 1 with the jogger arm in its raised position.

FIG. 3 is a reduced fragmentary top plan, with parts broken away, of a stapler unit of an electrophotographic copier incorporating the sheet jogger shown in FIG. 1.

FIG. 5 is a fragmentary top plan, with parts removed, of the sheet jogger shown in FIG. 1 with the jogger arm in its rest position.

FIG. 6 is a fragmentary top plan of the sheet jogger shown in FIG. 1 with the jogger arm in its raised position, showing one orientation of the jogging finger on its supporting pin.

FIG. 7 is a fragmentary top plan of the sheet jogger shown in FIG. 1 with the jogger arm in its raised position, showing a reversed orientation of the jogging finger on its supporting pin.

FIG. 8 is a schematic diagram of a circuit for controlling the actuation of the sheet joggers shown in FIGS. 3 and 4.

DESCRIPTION OF THE PREFERRED EMBODIMENTS

Figure 4:
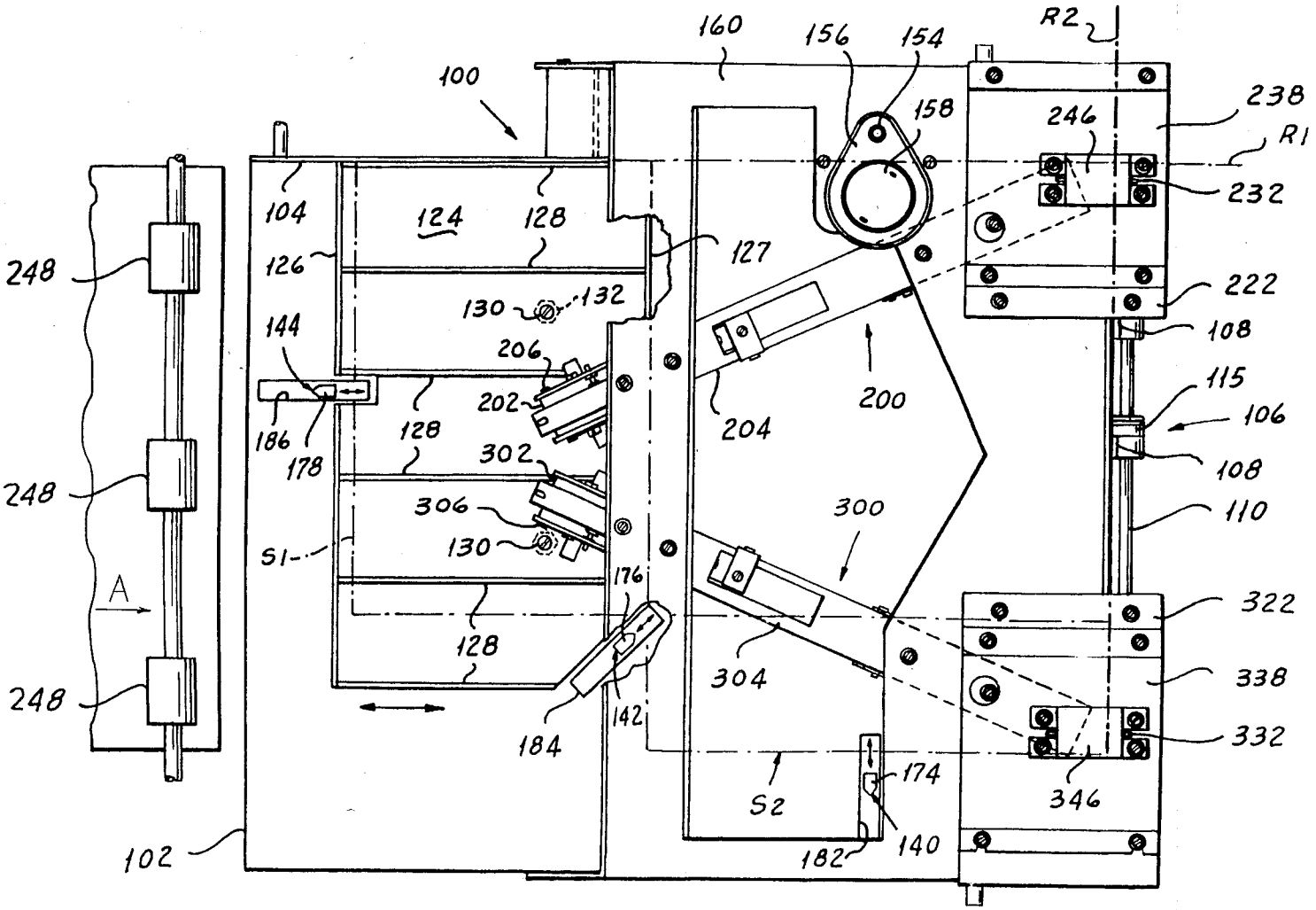
FIG. 4 is a bottom plan, with parts broken away, of the stapler unit shown in FIG. 3.
Figure 4:
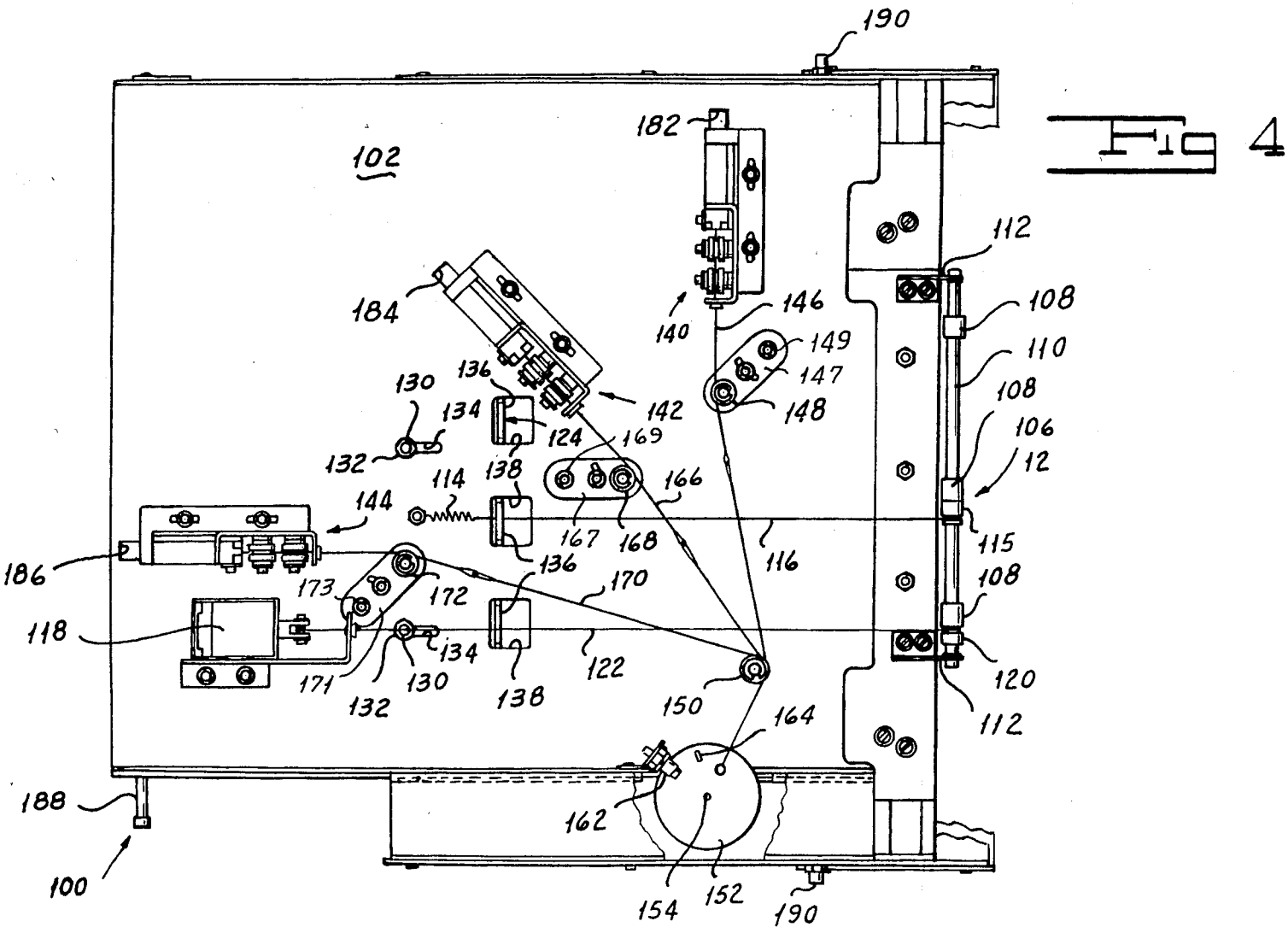

Referring now particularly to FIGS. 1, 2 and 5, my sheet jogger, indicated generally by the reference numeral 10, is intended for use with a plate 12 for receiving a stack 16 of sheets that are to be aligned with an imaginary planar registration surface R perpendicular to the plate 12. The jogger 10 includes a bracket 20 which is secured beneath the plate 12. A pivot 25 on bracket 20 supports a bell crank 22. Bracket 20 is formed with slots 21 for receiving suitable mounting screws (not shown) carried by the plate. Slots 21 are elongated to permit adjustment of the position of jogger 10 relative to support 12. Bell crank 22 includes a generally vertically extending lower arm 26 and a generally horizontally extending upper arm 24 perpendicular to the lower arm 26. Preferably, pivot 25 supports bell crank 22 at an intermediate location along the lower arm 26. Normally, a tension spring 28 extending between the lower arm 26 and a perpendicular extension 30 of bracket 20 biases bell crank 22 to the position shown in FIG. 1, with arm 24 resting against a lower limit stop 32.

A slider 38 movable along a longitudinal bore 40 in arm 24 carries a finger 34 extending perpendicularly upward out of bore 40 through a slot 44. A compression spring 42 disposed inside the bore 40 normally urges slider 38 to the right, as viewed in FIG. 1, to a limit position at the end of arm 24 defined by longitudinal slots 44 and 44' formed along arm 24, above and below bore 40, through which slots pin 36 extends. In this position of arm 24 and slider 38, jogging finger 34 remains below the level of the upper surface of plate 12. A flexible cord or lanyard 46 attached to slider 38 extends coaxially along the interior of spring 42 and along a groove 48 formed in the bell crank 22 at the inner end of bore 40. A first guide pulley 50 supported by a shaft 52 carried by bracket 20 and a second guide pulley 54 supported by a shaft 56 carried by bracket 20 direct lanyard 46 through an eyelet 58 carried by bracket extension 30 to a suitable tensioning source, such as the source to be described below.

The tensive force of spring 28 and the compressive force of spring 42 are so adjusted relative to each other that tension on line 46 first causes bell crank 22 to rotate counterclockwise about pivot 25 to the upper limit position shown in FIG. 2, defined by a stop 60 which abuts lower arm 26 in this position of bell crank 22. In this upper position of arm 24, jogging finger 34 extends upwardly through a slot 14 formed in plate 12. Further tension on line 46 draws slider 38 inwardly along bore 40 to draw jogging finger 34 to the position 34' shown in dot-dash lines in FIG. 2, flush with the desired registration surface R, or slighly beyond the surface R if a remote registration guide (not shown) for the opposite stack edge is also provided. Relaxation of line 46 allows jogging finger 34 first to return to the solid-line position shown in FIG. 2 under the action of spring 42, and then to return to the rest position shown in FIG. 1 under the action of spring 28.

As shown in FIG. 6, jogging finger 34 is generally pentagonal, having mutually perpendicular surfaces 35 and 35' making an angle of 135° with the side surfaces of the finger. Thus, if jogging finger 34 is to act against a single desired registration surface R, the finger is arranged on pin 36 with faces 35 and 35' turned away from the displaced position 34'. On the other hand, if the same finger is to act alternatively against mutually perpendicular registration surfaces R' and R'', as may happen when sheets are stacked in different orientations, the finger is reversed in the manner of finger 34*a* of FIG. 7, so that faces 35 and 35' are directed toward the displaced position 34*a*'. Thus, by suitably orienting finger 34 on pin 36, the same basic jogging mechanism may be used at various locations and against either one or two registration surfaces, without any other modification.

Referring now to FIGS. 3 and 4, a stapler deck or unit 100 incorporating joggers of the type shown in FIGS. 1 and 2 includes a generally upwardly facing plate 102. Sheets delivered to the plate 102 along a feed path A by feed rollers 248, which may be the exit rollers of an electrophotographic copier, are registered for stapling against a vertically and longitudinally extending lateral registration edge 104, located at the rear of the stapler deck 100, and against a retractable registration gate indicated generally by the reference numeral 106, comprising a plurality of upwardly extending fingers 108 located at the downstream, or exit, end of stapler deck 100. Lateral registration edge 104 and exit registration gate 106 cooperate with plate 102 to register a stack of, for example, 14-inch sheets fed lengthwise from feed rollers 48 at location S1, while registering a stack of, for example, 11-inch sheets fed widthwise from the rollers at location S2. Preferably, stapler deck 100 is inclined downwardly away from the end adjacent feed rollers 48 to facilitate the movement of the individual sheets onto, and stapled sets of sheets off of, the plate 102.

Transversely spaced brackets 112 located beneath the exit end of the plate 102 rotatably support a shaft 110 carrying the lower ends of the fingers 108. A spring 114 coupled by a lanyard 116 to a drum 115 mounted on shaft 110 normally maintains the gate fingers 108 in a raised position in which they retain the leading edges of sheets deposited on the plate 102. A second lanyard 122 couples a drum 120 also mounted on shaft 110 to a solenoid 118 located beneath the plate 102. Actuation of solenoid 118 rotates shaft 110 to move the gate fingers 108 from their raised position to a retracted position below the level of the plate 102, permitting a stapled set of sheets to drop off the exit end of the deck 100 into an output bin (not shown).

Plate 102 carries a pusher plate, indicated generally by the reference numeral 124, extending generally transversely from the lateral registration edge 104. Pusher plate 124 is formed with a first raised portion or catch 126 located just upstream of the trailing edge of a stack S1 of extra-length sheets fed lengthwise and a second raised portion or catch 127 extending transversely just upstream of the trailing edge of a stack S2 of normal-length sheets fed widthwise to the deck 100. Pusher plate 124 includes longitudinal ribs 128 on its upper surface to minimize electrostatic attraction between the plate and an accummulating stack of sheets. Transversely spaced screws 130 carried by pusher plate 124 extend through respective longitudinal slots 134 formed in the plate 102 to receive nuts 132 to locate the pusher plate 124 for sliding movement relative to the plate 102. Transversely spaced depending portions 136 of plate 124 extend through slots 138 in support 102 to define limit positions for the longitudinal movement of the pusher plate. One of the depending portions 136 is attached to lanyard 116 so that pusher plate 124 is normally maintained in the position shown in FIGS. 3 and 4 with the raised portion 126 or 127 behind the trailing edge of stack S1 or S2, respectively. Actuation of solenoid 118 to retract registration gate fingers 108 simultaneously moves pressure plate 124 to an advanced position, defined by depending portions 136 and slots 138, to initiate the slide of the stapled set of sheets off the exit end of the plate 102.

To maintain an accumulating stack of sheets S1 or S2 in a registered position against lateral registration edge 104 and registration gate fingers 108, stapler deck 100 includes sheet joggers indicated generally by the reference numerals 140, 142, and 144, each identical to the jogger 10 shown in FIGS. 1 and 2. More particularly, jogger 140 includes a finger 174 which, upon actuation of a line 146, moves upwardly through a slot 182 formed in plate 102 and transversely against the front edge of a widthwise-fed stack of sheets S2 to urge the stack against the lateral registration edge 104. In a similar manner, jogger 142 includes a finger 176 which, upon actuation of a line 166, moves upwardly through a slot 184 formed in the plate 102 and diagonally in the direction of registration edge 104 and registration gate fingers 108. Jogging finger 176 acts against either the front edge of a lengthwise-fed stack S1 of sheets to urge the stack against the lateral registration edge 104 or against the trailing edge of a widthwise-fed stack of sheets S2 to urge that stack against registration gate fingers 108.

Jogger 144 includes a finger 178 which, upon actuation of a line 170, moves upwardly through a slot 186 formed in plate 102 and longitudinally against the trailing edge of a lengthwise-fed stack S1 of sheets on the plate 102 to urge the stack against the exit registration gate fingers 108. Jogging fingers 140 and 144 are arranged on their supporting pins (not shown) in the manner of finger 34 in FIG. 6, while finger 142 is arranged on its pin in the manner of finger 34*a* in FIG. 7. While entirely separate jogging elements could be used to urge stacks S1 and S2 to registered positions against lateral edge 104 and gate fingers 108, the use of a common jogging finger 176 disposed adjacent the intersection of the two stacking orientations materially simplifies this aspect of the overall assembly.

First and second guide pulleys 148 and 150 carried beneath plate 102 direct lanyard 146 between jogger 140 and the periphery of a disk 152 carried by a vertical shaft 154. In a similar manner, guide pulley 150, in conjunction with another guide pully 168, directs actuating line 166 between jogger 142 and the same attachment point of disk 152. A further guide pulley 172 cooperates with pulley 150 to direct actuating line 170 between jogger 144 and the same attachment point of disk 152. Respective supports 147, 167 and 171 carrying pulleys 148, 168 and 172 may be adjustably positioned about pivots 149, 169 and 173 to adjust the tension in lines 146, 166 and 170. Shaft 154 couples disk 152 through a gear box 156 to a motor 158 supported by a platform 160 disposed above plate 102 and extending parallel thereto. Motor 158 is driven at the proper time in a manner to be described to rotate the disk 152 through a single revolution to actuate joggers 140, 142 and 144 simultaneously following the delivery of a sheet to the stapler deck 100. Disk 152 is formed with a perforation 164 which sweeps through the light path of an optical sensor 162 to provide a signal to the control system to be described indicating that the disk 152 has reached an arbitrary home position.

The rear stapler assembly of the stapler deck 100, indicated generally by the reference numeral 200, includes a stapler head 202 pivotally secured by means of pins 206 to a support, or housing, 204 secured to the underside of the platform 160. Stapler head 202 is normally biased to a position spaced above plate 102. As shown in FIG. 3, stapler head 202 is arranged to form an angle of about 24° with the direction of feed A from rollers 48. Stapler head 202 is so spaced from the registration surfaces R1 and R2 defined by edge 104 and fingers 108 respectively as to insert a staple into a stack S1 of lengthwise-fed sheets at a point spaced one centimeter from each of the adjacent stack edges.

The front stapler assembly 300 of the stapler deck 100, identical to rear assembly 200 except for the reversal of parts, includes a stapler head 302 pivotally secured by means of pins 306 to a support 304 secured to the underside of the platform 160. Stapler 302 is normally biased to a position spaced upwardly from the received surface 102. Stapler head 302 is arranged to form an angle of about 24° with the direction of feed A from exit rollers 248. Stapler head 302 is so spaced from the registration surfaces R1 and R2 defined by edge 104 and fingers 108 respectively as to insert a staple into a stack S2 of widthwise-fed sheets at a point spaced one centimeter from the stack edge adjacent surface R2 and from the stack edge remote from surface R1.

Referring now to FIG. 8, a suitable control circuit for actuating the jogger motor 158 in response to a jog command signal appearing on a line 62 may comprise an RS flip-flop 64 that is set in response to the signal on line 62. Upon being set, flip-flop 64 supplies an output to a driver 66 of any suitable type known to the art, which actuates the jogger motor 158 to tension the lines 146, 166 and 170 of the respective jogger assemblies 140, 142 and 144. When the disk 152 to which the lines are attached rotates to a position at which perforation 164 reaches optical sensor 162, sensor 162 provides a signal to the reset input of flip-flop 64 to disable the jogger motor 158 until the receipt of a further jog command signal on line 62. As will be apparent to those skilled in the art, in addition to controlling the jogging mechanism in the manner described, it is also possible to control such a mechanism using a programmed general purpose computer that may also be used to control other elements of the stapler deck 100 or copier.

It will be seen that I have accomplished the objects of my invention. My sheet jogger is relatively simple in construction, but does not interfere with the feeding of sheets to the receiving surface. Further, the various jogging elements of my sheet jogger may be commonly actuated by a single mechanism. Although my sheet jogger is relatively insensitive to changes in location of a jogging mechanism relative to the sheet support or actuating device, its jogging elements are nevertheless effective to strike adjacent sheet edges normally from a starting position below the receiving surface.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. Sheet registering apparatus including in combination means for receiving a stack of sheets, said receiving means having a generally planar sheet-receiving surface, a support, a jogger element mounted for rectilinear movement on said support in a direction generally parallel to said surface, means mounting said support for movement of said support in a direction generally normal to said surface between a first position relatively remote from the plane of said surface and a second position relatively adjacent thereto, and means for moving said support from said first position to said second position and then moving said jogger element rectilinearly relative to said support into engagement with said stack.

2. Apparatus as in claim 1 in which said support comprises an arm, said mounting means comprising means mounting said arm for pivotal movement of said arm between said first and second positions.

3. Apparatus as in claim 1, comprising means for biasing said support into one of said positions.

4. Apparatus as in claim 1 in which said moving means comprises means for exerting an actuating force on said jogger element to move said support between said first and second positions.

5. Apparatus as in claim 1 in which said moving means comprises a flexible member coupled to said jogger element and means for tensioning said flexible member to move said support between said first and second positions.

6. Sheet registering apparatus including in combination means for receiving a stack of sheets, an arm, a jogger element mounted for movement along said arm, means mounting said arm for pivotal movement of said arm between a first position relatively remote from said receiving means and a second position relatively adjacent thereto, and means for moving said arm from said first position to said second position and then moving said element along said arm into engagement with said stack.

7. Apparatus as in claim 6, comprising means for biasing said jogger element in a predetermined direction along said arm.

8. Apparatus for aligning the edges of sheets successively fed to a generally planar receiving surface with a predetermined registration plane including in combination a support, a jogger element carried by said support, means mounting said support adjacent to said surface for movement in a direction generally normal to said surface between a first position at which said jogger element is clear of said surface and a second position at which said jogger element extends through the plane of said surface at a location spaced from said registration plane, means mounting said jogger element on said support for rectilinear movement on said support from said location to said plane, and means for first moving said support from said first position to said second position and then moving said jogger element rectilinearly relative to said support from said location to said plane.

9. Apparatus as in claim 8 in which said jogger element has a sheet-engaging surface which is substantially perpendicular to the direction of movement of said element.

10. Apparatus as in claim 8 in which said jogger element has respective sheet-engaging surfaces which are angularly disposed with relation to the direction of movement of the element.

11. Apparatus as in claim 8 in which said jogger element is end-to-end reversibly mounted on said support, one end of said element having a sheet-engaging surface which is substantially perpendicular to the direction of movement of said element, the other end of said element having respective sheet-engaging surfaces which are relatively angularly disposed with reference to said direction of movement.

12. Apparatus for aligning the edges of sheets successively fed to a receiving surface with a predetermined plane including in combination an arm, a jogger finger carried by said arm and extending laterally outwardly thereof, means mounting said arm adjacent to said surface for pivotal movement of said arm between a first position at which said jogger finger is clear of said surface and a second position at which said jogger finger extends through said surface, means mounting said jogger finger on said arm for rectilinear movement of said finger, with said arm in said second position, along said arm from a location remote from said plane to said plane, means for biasing said arm to said first position, means for biasing said finger to said location, and means for sequentially moving said arm to said second position and said finger to said plane.

13. Apparatus as in claim 12 in which said moving means comprises means for exerting an actuating force on said jogger finger, the construction of said arm and finger biasing means being such that said actuating force first overcomes said arm biasing means to move said arm to said second position and then overcomes said finger biasing means to move said finger to said plane.

14. Apparatus as in claim 12 in which said moving means comprises a flexible member attached to said finger.

* * * * *